US005633656A

United States Patent [19]

Hsu et al.

[11] Patent Number: 5,633,656

[45] Date of Patent: May 27, 1997

[54] CONTROLLING APPARATUS FOR DISPLAY OF AN ON-SCREEN MENU IN A DISPLAY DEVICE

[75] Inventors: Hung-Chang Hsu, Hsing-Chuang; Chyi-Cheng Lin, Taipei, both of Taiwan

[73] Assignee: Acer Peripherals, Inc., Taoyuan, Taiwan

[21] Appl. No.: 57,286

[22] Filed: May 5, 1993

[51] Int. Cl.[6] ..... G09G 5/22

[52] U.S. Cl. ..... 345/141; 345/192; 345/193

[58] Field of Search ..... 345/25, 26, 27, 345/141, 192–195

[56] References Cited

U.S. PATENT DOCUMENTS

| | | | |
|---|---|---|---|
| 4,384,285 | 5/1983 | Long et al. | 345/26 |
| 4,653,020 | 3/1987 | Cheselka et al. | 345/141 |
| 4,672,371 | 6/1987 | Bugg | 345/195 |
| 4,831,369 | 5/1989 | Lecourtier | 345/194 |
| 4,864,518 | 9/1989 | Kurita | 345/141 |
| 4,922,237 | 5/1990 | Inoue | 345/27 |

*Primary Examiner*—Steven Saras
*Attorney, Agent, or Firm*—Townsend and Townsend and Crew LLP; Joseph M. Villeneuve

[57] ABSTRACT

An apparatus for controlling an on-screen menu for television and display monitors. The apparatus includes a first data bus having a plurality of data lines including a least significant bit line. The first data bus transmits display information, the display information including alphanumeric data and attribute data relating to the parameters of the on-screen menu. A display buffer for storing both types of display information is coupled to the first data bus. The display buffer generates the alphanumeric data when a select signal is in a prescribed logic state, and generates the attribute data when the select signal is the complement of the prescribed logic state. A latch circuit for generating the select signal is coupled to the first data bus. By generating the select signal, the latch circuit causes the display buffer to generate the attribute data at a different time from the alphanumeric data. The latch circuit may then latch the attribute data by means of its connection to the first data bus. A read-only memory is coupled to the first data bus and generates a character signal in response to the alphanumeric data. A second data bus coupled to the read-only memory transmits the character signal to a shift register which then converts the parallel signal to a serial signal and transmits the serial signal to the display.

18 Claims, 3 Drawing Sheets

CONTROLLING APPARATUS FOR DISPLAY OF AN ON-SCREEN MENU IN A DISPLAY DEVICE

BACKGROUND OF THE INVENTION

This invention relates to an apparatus for controlling the display of an on-screen menu in a display device, and in particular, to an apparatus which may be programmed to alter the location of a cell, and the size, foreground color, and background color of an on-screen menu.

On-screen menus for televisions and displays are a relatively recent development. In one application, an on-screen menu is used to display the parameters of a monitor to facilitate adjustment of the parameters. FIG. 1 shows an on-screen menu 12 within the display 13 of a monitor 11. Display output 14 shown in the upper left hand corner of display 13 represents the output of a computer system connected to the monitor. On-screen menu area 12 appears on display 13 and overwrites display output 14 when a button (not shown) associated with monitor 11 is activated. The area of on-screen menu 12 is generally referred to as the background and the alphanumeric display 121 within the background is generally referred to as the foreground. In one application, the alphanumeric characters of the foreground are used to display the parameters of a monitor. By manipulating these parameters and a plurality of dials, the user may change the configuration of display output 14.

FIG. 2 is a schematic diagram of a typical circuit used to implement the on-screen menu of FIG. 1. An address counter 26 transmits an address signal to a display buffer 22 via a signal line 61. Display buffer 22 transmits a stored address value to the address input of a read-only memory (ROM) 23 via a data bus 21. ROM 23 transmits selected alphanumeric data in parallel to a shift register 24 via signal lines 31 in response to the address value from display buffer 22. In other words, ROM 23 is a character generator. Shift register 24 converts the alphanumeric data on signal lines 31 from parallel to serial form and then transmits the serial data to a cathode ray tube (not shown). Display buffer 22 generally is a Random Access Memory (RAM). Data bus 21 generally is an eight bit data bus.

One conventional approach uses the least significant bit (LSB) of data bus 21 as signal line for the on-screen menu attribute data. Attribute data include cell locations, and the size and color of on-screen menu background and foreground. Because the LSB is used in this manner, only the seven most significant bits may be used to address ROM 23. This means only 128 ($2^7$) characters are available in such a conventional display system. Unfortunately, in commercial environments, 128 characters are not sufficient for complicated applications. This problem is exacerbated in applications in which two bits are required for attribute dam. In such situations, only 64 ($2^6$) characters are available.

In order to implement the desired 256 characters, some conventional systems employ an additional ROM 25 to store attribute data. In such systems, all eight bits of data bus 21 may be used to select a character. ROM 25 is addressed by the address signal 61 and transmits stored attribute data on a signal line 51. However, the addition of ROM 25 unnecessarily increases the system's cost and complexity. This is especially true when the system is implemented in a programmable integrated circuit, such as, for example, an Application Specific Integrated Circuit (ASIC).

Another disadvantage of this type of system is the lack of flexibility with regard to the parameters of the on-screen menu. Because the data stored in ROM 25 is fixed after the mask programming process, the attributes of the on-screen menu are not alterable. This means that the display of the on-screen menu is not software programmable. If programming capability is desired for the system, a RAM may be used to replace ROM 25. However, because this would result in two RAMs being employed in the system, the required programming time may be longer and more complex than desired.

SUMMARY OF THE INVENTION

The invention provides an apparatus for controlling an on-screen menu for television and display monitors. The invention solves the above-described problems by employing a latch circuit which generates and transmits a select signal to the display buffer. When the select signal is in a first state, the data buffer transmits alphanumeric data. When the select signal is the complement of the first state, the data buffer transmits attribute data which is then captured by a series of flip-flops in the latch circuit. Because the two different types of data are transmitted at mutually exclusive times, all of the lines on the data bus may be used to transmit alphanumeric data (or attribute data for that matter), thereby maximizing the number of different characters possible without the need for additional ROM.

The apparatus includes a first data bus having a plurality of data lines including a least significant bit line. The first data bus transmits display information, the display information including alphanumeric data and attribute data relating to the parameters of the on-screen menu. A display buffer for storing both types of display information is coupled to the first data bus. The display buffer generates the alphanumeric data when a select signal is in a prescribed logic state, and generates the attribute data when the select signal is the complement of the prescribed logic state. A latch circuit for generating the select signal is coupled to the first data bus. By generating the select signal, the latch circuit causes the display buffer to generate the attribute data at a different time from the alphanumeric data. The latch circuit may then latch the attribute data by means of its connection to the first data bus.

A read-only memory is coupled to the first data bus and generates a character signal in response to the alphanumeric data. A second data bus coupled to the read-only memory transmits the character signal to a shift register which then converts the parallel signal to a serial signal and transmits the serial signal to the display.

In one embodiment, the latch circuit is coupled to the least significant bit line of the first data bus, but it will be understood by those skilled in the art that the latch circuit may be coupled to any number of the data lines in the first data bus. Multiple data lines allow for attribute data of greater complexity. In such an embodiment, simple redundancies may be introduced into the latch circuit to provide for latch circuitry for each data line.

A further understanding of the nature and advantages of the present invention may be realized by reference to the remaining portions of the specification and the drawings.

DESCRIPTION OF SPECIFIC EMBODIMENTS

Figure 1:
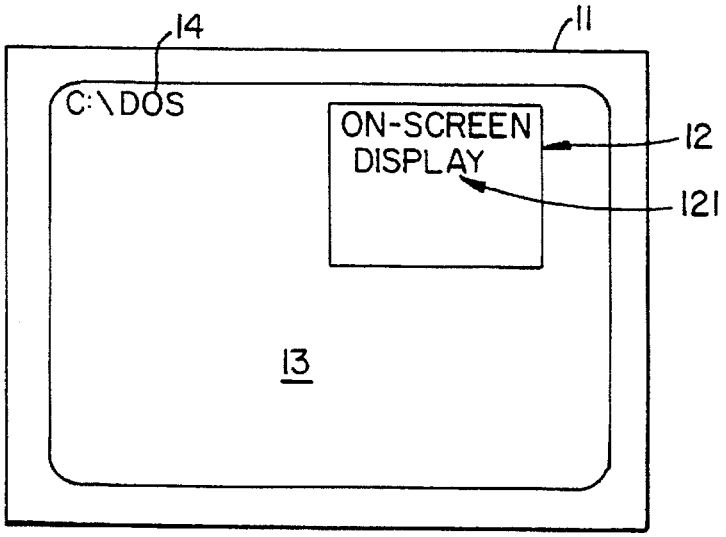
FIG. 1 shows an on-screen menu within the display of a monitor.
Figure 2:
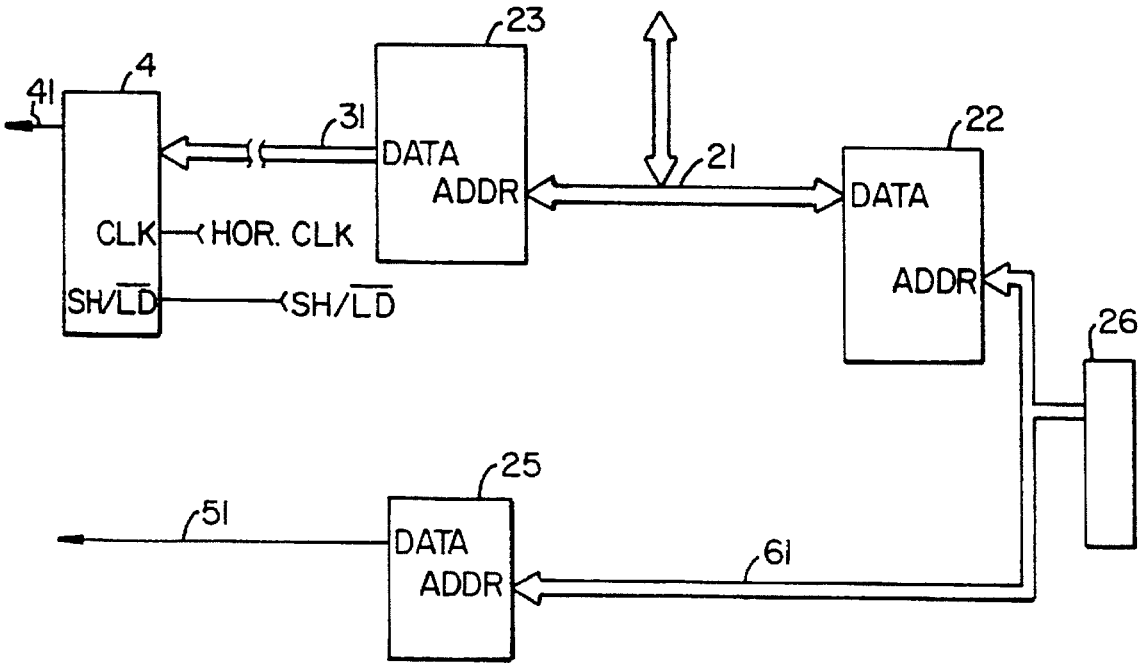
FIG. 2. (PRIOR ART)
FIG. 2 is a drawing of related function blocks which result in a desired display of an on-screen menu in accordance with the prior art.
Figure 3:
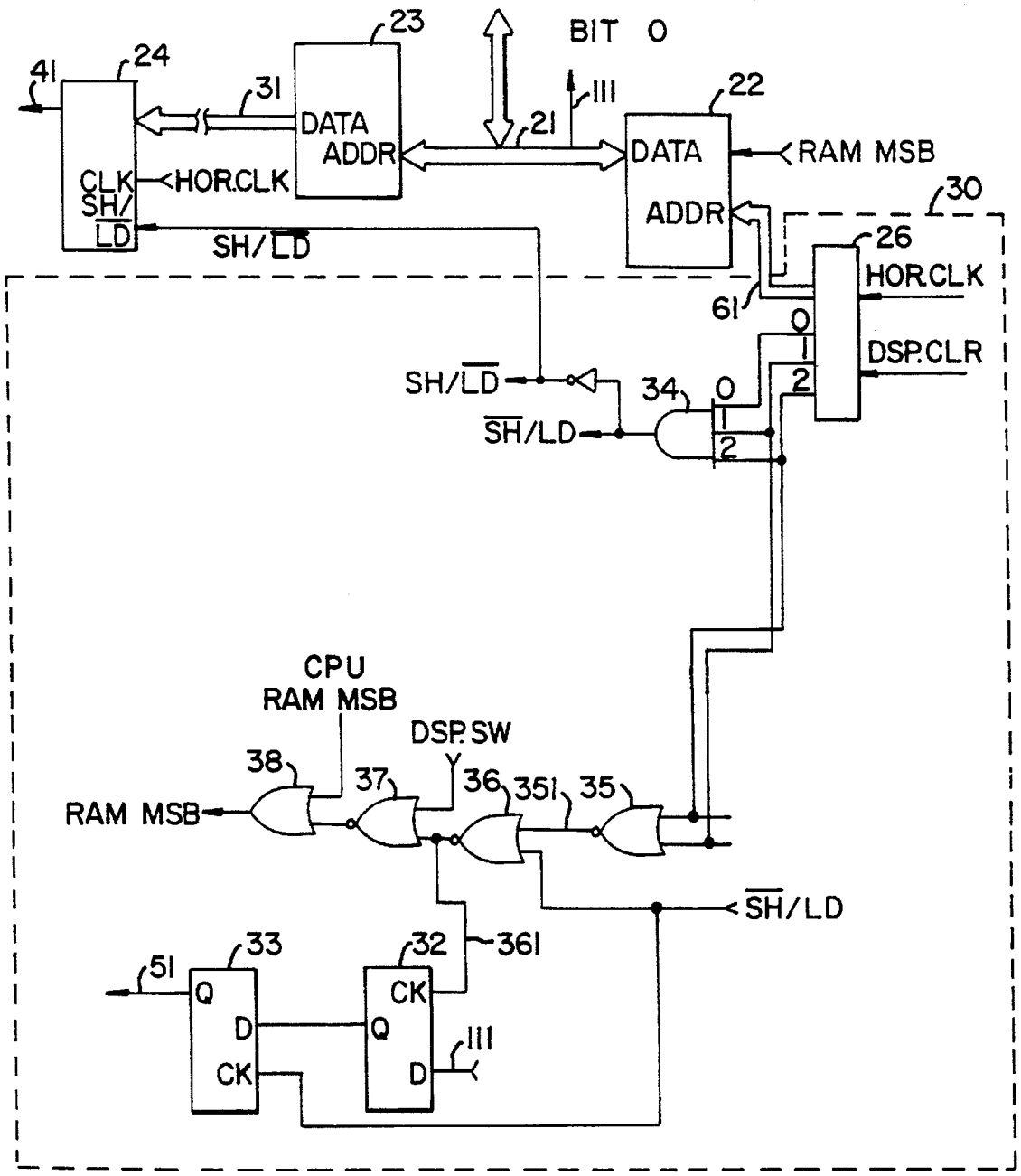
FIG. 3 is a schematic of an apparatus for controlling the display of on-screen menu in accordance with a specific embodiment of the invention.

FIG. 3 is a schematic diagram showing one embodiment of an on-screen control circuit designed according to the invention. Reference numerals corresponding to those in FIG. 2 are used for corresponding elements in FIG. 3. Display buffer 22 stores both the alphanumeric data and attribute data relating to the display of an on-screen menu. At a first point in time, shift register 24 receives parallel data on signal lines 31 under the control of the SH/$\overline{\text{LD}}$ signal. A latch circuit 30 is coupled to data bus 21 via the bit zero line 111 of data bus 21. In response to the control signal $\overline{\text{SH}}$/LD, latch circuit 30 transmits a select signal (RAM MSB). When asserted, RAM MSB causes display buffer 22 to transmit attribute dam. At a second point in time, latch circuit 30 latches the attribute data via the bit zero line 111 of display buffer 22. At the same time, the state of RAM MSB changes and display buffer 22 is again ready to transmit alphanumeric data on data bus 21.

In one embodiment, latch circuit 30 comprises a binary counter 26 which generates a zero bit output (LSB), a first bit output (LSB+1), and a second bit output (LSB+2); and an AND gate 34 which has three input terminals which receive the zero, first, and second bit outputs respectively, and in response thereto transmits a control signal $\overline{\text{SH}}$/LD. Latch circuit 30 further comprises a first NOR gate 35 which has two input terminals which receive the first and second bit outputs respectively, and transmits a first output signal on signal line 351. Latch circuit 30 also includes a second NOR gate 36 which has two input terminals which receive the first output signal and the control signal $\overline{\text{SH}}$/LD, and transmits a second output signal on a line 361 in response thereto. Latch circuit 30 also includes a first D type flip-flop 32 which, in response to the second output signal, latches attribute data from the bit zero line of data bus 21. Latch circuit 30 further comprises a second D type flip-flop 33, the data terminal of which is coupled to the Q output of the first D type flip-flop 32. The Q output of flip-flop 33 transmits attribute data on signal line 51 in response to the control signal $\overline{\text{SH}}$/LD at the clock terminal of flip-flop 33.

In FIG. 3, HOR.CLK is a dot clock signal, which comes from a dot rate generator (not shown). HOR.CLK increments the address counter 26 and is used to extract the character signal stored in the shift register 24 serially, dot by dot. DSP.CLR is a clear signal for address counter 26. When DSP.CLR is a logic low, counter 26 is clear. As DSP.CLR changes from logic low to logic high, latch circuit 30 starts to function. CPU RAM MSB is a control signal for accessing display buffer 22, and is kept logic low when display buffer 22 is transmitting data. When the user desires to write data into display buffer 22, DSP.SW is set high to let the CPU control the display buffer 22. DSP.SW is an on-screen menu display control signal. When DSP.SW is low, RAM MSB takes the inverse shape of that of the second output signal on line 361. Latch circuit 30 further comprises a NOR gate 37 and an OR gate 38. NOR gate 37 receives DSP.SW and the second output signal, and generates one of the inputs to OR gate 38. The other input to OR gate 38 is CPU RAM MSB. OR gate 38 transmits the select signal RAM MSB.

Figure 4:
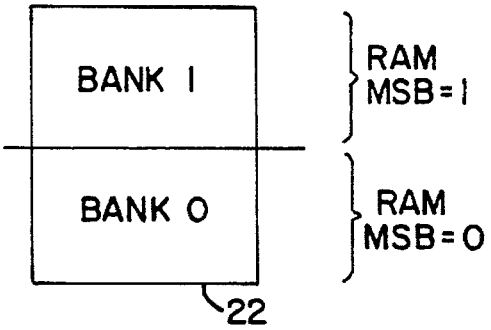
FIG. 4 shows a specific embodiment of the display buffer of FIG. 3.

FIG. 4 shows an embodiment of display buffer 22. As shown, attribute data are stored in bank one and are accessible when RAM MSB is logic "1". The alphanumeric data are stored in bank zero and are accessible when RAM MSB is logic "0".

Figure 5:
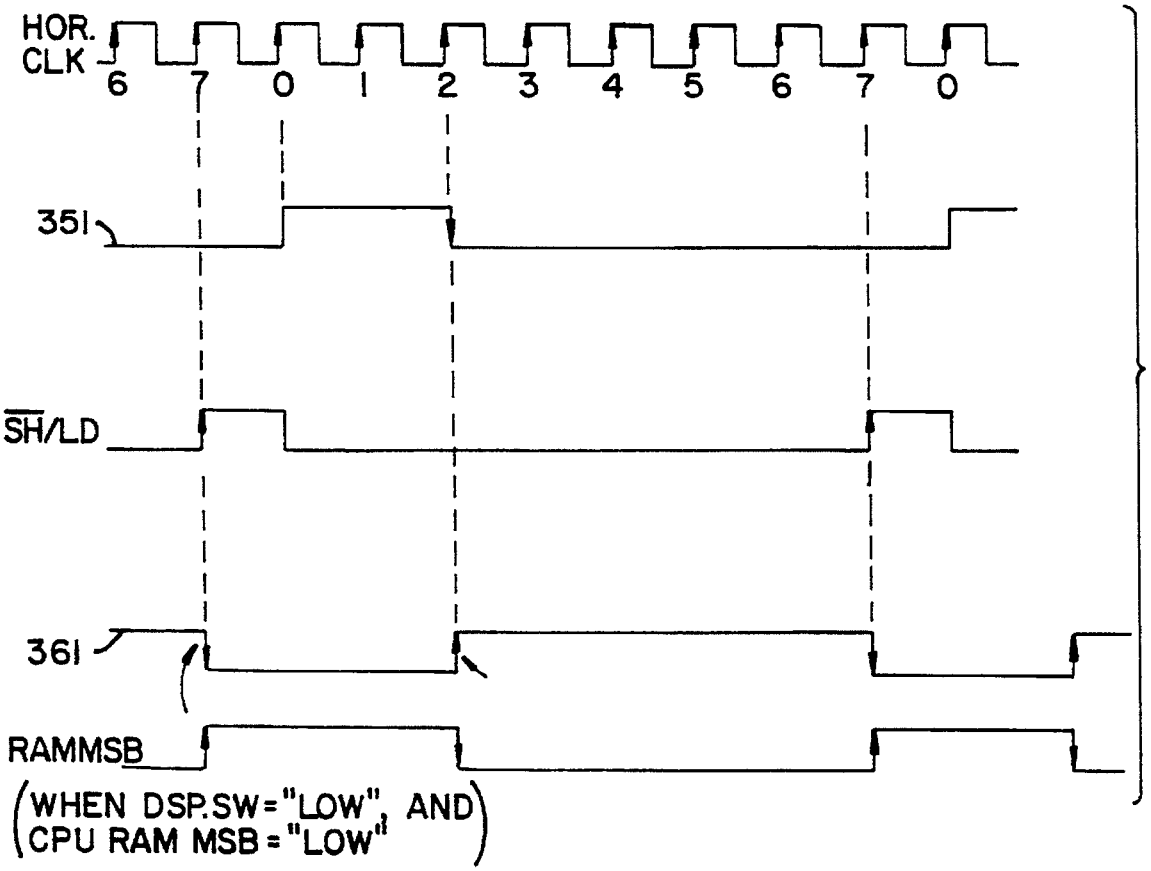
FIG. 5 is a timing diagram of signals represented in FIG. 3.

FIG. 5 is a timing diagram depicting the timing of the related signals of FIG. 3. Because each of the characters stored in ROM 23 is an 8*8 dot matrix, the cycles of HOR.CLK are numbered from 0 to 7 for illustrative purposes. It can easily be shown that the first output signal on line 351 (signal 351) goes high at each 0 and low at each 2. When signal 351 goes low, the second output signal (signal 361) goes high and attribute data from display buffer 22 is latched into flip-flop 32 via the bit zero line of data bus 21.

It is also easily shown that $\overline{\text{SH}}$/LD goes high at each 7 and low at each 0. When $\overline{\text{SH}}$/LD goes high, alphanumeric data from ROM 23 is transmitted on data lines 31 and loaded into shift register 24. Signal 361 goes low at each 7 and high at each 2. When RAM MSB goes low, display buffer access is shifted to bank zero. When $\overline{\text{SH}}$/LD goes high, attribute data is latched into the flip-flop 33, appearing on signal line 51.

The above-described embodiment employs only the bit zero line of data bus 21 to transfer the attribute data. It will be understood that other bit lines or combinations thereof may be used to implement the present invention. Additional flip-flops may be employed in the described manner so that more than one piece of attribute data may be latched at the same time. For example, if eight attribute data are required for a versatile on-screen menu system, then eight sets of flip-flops may be employed to latch the attribute data via all eight bits of data bus 21. Additionally, it will be understood that because display buffer 22 is programmable, on-screen menus in systems incorporating the present invention are easily altered by the user.

While the invention has been particularly shown and described with reference to specific embodiments thereof, it will be understood by those skilled in the art that the foregoing and other changes in the form and details may be made therein without departing from the spirit or scope of the invention.

What is claimed is:

1. An apparatus for controlling an on-screen menu, comprising:

a first data bus having a plurality of data lines including a least significant bit line, the first data bus being for transmitting display information to a character generator, the display information comprising alphanumeric data and attribute data relating to the on-screen menu;

a display buffer coupled to the first data bus for storing the display information, generating the alphanumeric data when a select signal is in a prescribed logic state, and generating the attribute data when the select signal is the complement of the prescribed logic state; and a latch circuit coupled to the first data bus for generating the select signal, thereby causing the display buffer to generate the attribute data and the alphanumeric data at different times;

wherein all of the data lines of the first data bus are operable to transmit the alphanumeric data when the select signal is in the prescribed logic state, and all of the data lines of the first data bus are operable to transmit the attribute data when the select signal is the complement of the prescribed logic state.

2. The apparatus of claim 1 wherein the display buffer comprises a programmable random-access memory.

3. The apparatus of claim 1 wherein the latch circuit is coupled to at least one data line in the first data bus.

4. The apparatus of claim 1 wherein the number of data lines in the first data bus is eight.

5. The apparatus of claim 1 wherein the latch circuit is coupled to the least significant bit line in the first data bus.

6. The apparatus of claim 1, further comprising:

a read-only memory means coupled to the first data bus for generating a character signal in response to the alphanumeric data;

a second data bus coupled to the read-only memory for transmitting the character signal; and a shift register coupled to the second data bus for receiving the character signal in response to the complement of a control signal.

7. An apparatus for controlling an on-screen menu, comprising:

a first data bus having a plurality of data lines including a least significant bit line, the first data bus being for transmitting display information to a character generator, the display information including alphanumeric data and attribute data relating to the on-screen menu;

a display buffer coupled to the first data bus for storing the display information, generating the alphanumeric data when a select signal is in a prescribed logic state, and generating the attribute data when the select signal is the complement of the prescribed logic state;

a read-only memory means coupled to the first data bus for generating a character signal in response to the alphanumeric data;

a second data bus coupled to the read-only memory for transmitting the character signal;

a shift register coupled to the second data bus for receiving the character signal at a first time point in response to the complement of a control signal; and a latch circuit coupled to the first data bus for generating the select signal in response to the control signal, the select signal causing the display buffer to transmit the attribute data;

wherein all of the data lines of the first data bus are operable to transmit the alphanumeric data when the select signal is in the prescribed logic state, and all of the data lines of the first data bus are operable to transmit the attribute data when the select signal is the complement of the prescribed logic state.

8. The apparatus of claim 7 wherein the display buffer comprises a programmable random-access memory.

9. The apparatus of claim 7 wherein the latch circuit is coupled to at least one data line in the first data bus.

10. The apparatus of claim 7 wherein the number of data lines in the first data bus is eight.

11. The apparatus of claim 7 wherein the latch circuit is coupled to the least significant bit line in the first data bus.

12. The apparatus of claim 7 wherein the latch circuit comprises:

a counter having three output terminals;

an AND gate having three input terminals coupled to the three counter output terminals, the AND gate generating the control signal at an AND gate output terminal;

a first NOR gate having two input terminals connected to two of the counter output terminals, and a first NOR gate output terminal;

a second NOR gate having two inputs terminals connected to the AND gate output terminal and the first NOR gate output terminal, the second NOR gate generating a second output signal at a second NOR gate output terminal;

a first flip-flop having a first flip-flop data input terminal coupled to the first data bus, a first flip-flop clock input terminal coupled to the second NOR gate output terminal, and a first flip-flop output terminal, the first flip-flop being for latching the attribute data from the first data bus in response to the second output signal;

a second flip-flop having a second flip-flop data input terminal coupled to the first flip-flop output terminal, a second flip-flop clock input terminal coupled to the AND gate output terminal, and a second flip-flop output terminal, the second flip-flop being for transmitting the attribute data in response to the application of the control signal; and gate circuitry coupled to the second NOR gate output terminal for generating the select signal in response to the second output signal, an on-screen menu display control signal and a display buffer access control signal.

13. The apparatus of claim 12 wherein the flip-flops comprise D type flip-flops.

14. The apparatus of claim 12 wherein the latch circuit is coupled to more than one data line in the first data bus, the latch circuit further comprising:

a latch flip-flop for each data line coupled to the latch circuit, each latch flip-flop having a latch flip-flop data input terminal coupled to a data line of the first data bus, a latch flip-flop clock input terminal coupled to the second NOR gate output terminal, and a latch flip-flop output terminal, the latch flip-flop being for latching the attribute data from the first data bus in response to the second output signal; and a data flip-flop for each latch flip-flop, each data flip-flop having a data flip-flop data input terminal coupled to a latch flip-flop output terminal, a data flip-flop clock input terminal coupled to the AND gate output terminal, and a data flip-flop output terminal, the data flip-flop being for transmitting the attribute data in response to the application of the control signal.

15. An apparatus for controlling an on-screen menu, comprising:

a first data bus having a plurality of data lines including a least significant bit line, the first data bus being for transmitting display information, the display information including alphanumeric data and attribute data relating to the on-screen menu;

a display buffer coupled to the first data bus for storing the display information, generating the alphanumeric data when a select signal is in a prescribed logic state, and generating the attribute data when the select signal is the complement of the prescribed logic state;

a read-only memory means coupled to the first data bus for generating a character signal in response to the alphanumeric data;

a second data bus coupled to the read-only memory for transmitting the character signal;

a shift register coupled to the second data bus for receiving the character signal at a first time point in response to the complement of a control signal;

a latch circuit coupled to the least significant bit line of the first data bus for generating the select signal in response to the control signal, the select signal causing the display buffer to transmit the attribute dam, the latch circuit latching the attribute data at a second time point, the latch circuit comprising:

a counter having three output terminals;

an AND gate having three input terminals coupled to the three counter output terminals, the AND gate generating the control signal at an AND gate output terminal;

a first NOR gate having two input terminals connected to two of the counter output terminals, and a first NOR gate output terminal;

a second NOR gate having two inputs terminals connected to the AND gate output terminal and the first NOR gate output terminal, the second NOR gate generating a second output signal at a second NOR gate output terminal;

a first flip-flop having a first flip-flop data input terminal coupled to the first data bus, a first flip-flop clock input terminal coupled to the second NOR gate output terminal, and a first flip-flop output terminal, the first flip-flop being for latching the attribute data from the first data bus in response to the second output signal;

a second flip-flop having a second flip-flop data input terminal coupled to the first flip-flop output terminal, a second flip-flop clock input terminal coupled to the AND gate output terminal, and a second flip-flop output terminal, the second flip-flop being for transmitting the attribute data in response to the application of the control signal; and gate circuitry coupled to the second NOR gate output terminal for generating the select signal in response to the second output signal, an on-screen menu display control signal and a display buffer access control signal.

16. The apparatus of claim 15 wherein the display buffer comprises a programmable random-access memory.

17. The apparatus of claim 15 wherein the flip-flops comprise D type flip-flops.

18. The apparatus of claim 15 wherein the latch circuit is coupled to more than one data line in the first data bus, the latch circuit further comprising:

a latch flip-flop for each data line coupled to the latch circuit, each latch flip-flop having a latch flip-flop data input terminal coupled to a data line of the first data bus, a latch flip-flop clock input terminal coupled to the second NOR gate output terminal, and a latch flip-flop output terminal, the latch flip-flop being for latching the attribute data from the first data bus in response to the second output signal; and a data flip-flop for each latch flip-flop, each data flip-flop having a data flip-flop data input terminal coupled to a latch flip-flop output terminal, a data flip-flop clock input terminal coupled to the AND gate output terminal, and a data flip-flop output terminal, the data flip-flop being for transmitting the attribute data in response to the application of the control signal.

* * * * *